US005397651A

United States Patent [19]

Wirz

[11] Patent Number: 5,397,651

[45] Date of Patent: Mar. 14, 1995

[54] FOIL FOR COVERING AN IMPRESSION CYLINDER

[75] Inventor: Arno Wirz, Bammental, Germany

[73] Assignee: Heidelberger Druckmaschinen AG, Heidleberg, Germany

[21] Appl. No.: 121,046

[22] Filed: Sep. 13, 1993

[30] Foreign Application Priority Data

Sep. 12, 1992 [DE] Germany ..... 42 30 567.5

[51] Int. Cl.[6] ..... B41F 13/00; B41N 7/00

[52] U.S. Cl. ..... 428/600; 428/667; 428/687; 101/420; 101/422

[58] Field of Search ..... 428/606, 600, 687, 666, 428/667, 141, 607; 101/420, 422

[56] References Cited

U.S. PATENT DOCUMENTS

| | | | |
|---|---|---|---|
| 487,121 | 11/1892 | Haggenmuller | 428/600 |
| 2,011,181 | 8/1935 | Melton et al. | 101/420 |
| 2,064,322 | 12/1936 | Ruppert | 428/600 |
| 2,221,890 | 11/1940 | Williams | 428/600 |
| 2,555,319 | 6/1951 | Cross | 101/422 |
| 2,804,417 | 8/1957 | Cross et al. | 101/420 |
| 3,261,288 | 7/1966 | Dickerson | 101/420 |
| 3,308,522 | 3/1967 | Miller | 29/120 |
| 3,874,331 | 4/1975 | Kirsen | 118/227 |
| 4,005,654 | 2/1977 | Gundlach | 101/426 |
| 4,327,135 | 4/1982 | Wirz et al. | 428/600 |
| 4,688,784 | 8/1987 | Wirz | 101/420 |
| 5,042,383 | 8/1991 | Wirz | 101/420 |

FOREIGN PATENT DOCUMENTS

| | | | |
|---|---|---|---|
| 0017776 | 6/1985 | European Pat. Off. . | |
| 2286715 | 4/1976 | France . | |
| 2820549 | 1/1979 | Germany . | |
| 2446188 | 11/1983 | Germany . | |
| 0486841 | 5/1992 | Germany . | |
| 2081178A | 2/1982 | United Kingdom | 101/422 |

OTHER PUBLICATIONS

European Search Report, Dec. 30, 1993, EP 93 11 3247, 4 pages.

*Primary Examiner*—John Zimmerman

*Attorney, Agent, or Firm*—Herbert L. Lerner; Laurence A. Greenberg

[57] ABSTRACT

Foil for covering an impression cylinder of a rotary offset printing press for first-form and perfector printing is formed of a chemically and wear-resistant rigid support layer having good ink transfer behavior and having a structured surface with statistically uniformly distributed convex and concave structural elements thereon, and a microroughness-reducing chromium layer disposed on the rigid support layer and forming a sheet-guiding outer cylindrical surface of the impression cylinder, respective peaks being formed on the convex structural elements for supporting a sheet thereon, each of the convex structural elements having an oval shape with a radius of curvature increasing from the respective peak thereof to a transition into respective concave structural elements adjacent thereto.

3 Claims, 2 Drawing Sheets

Fig.1
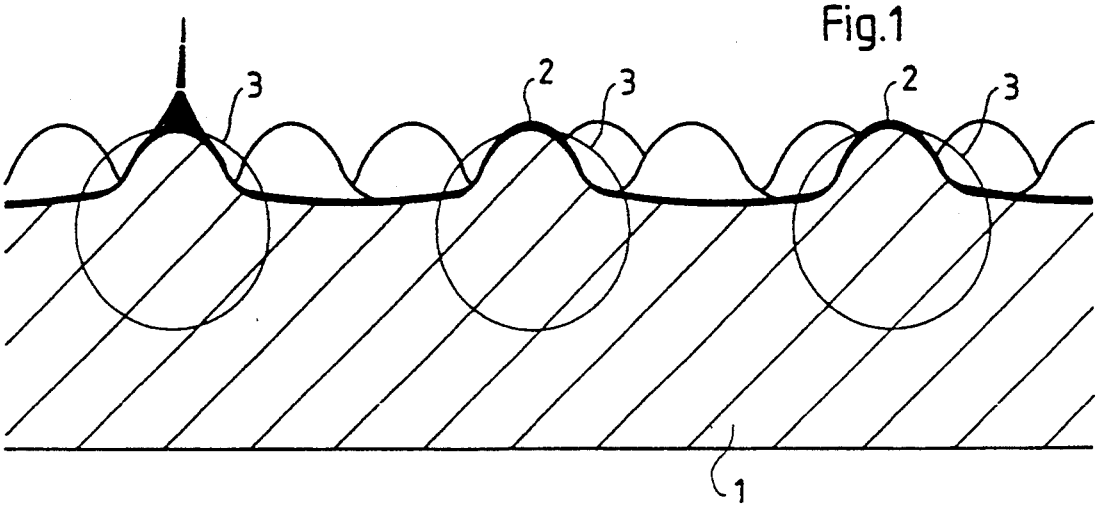
Fig.2
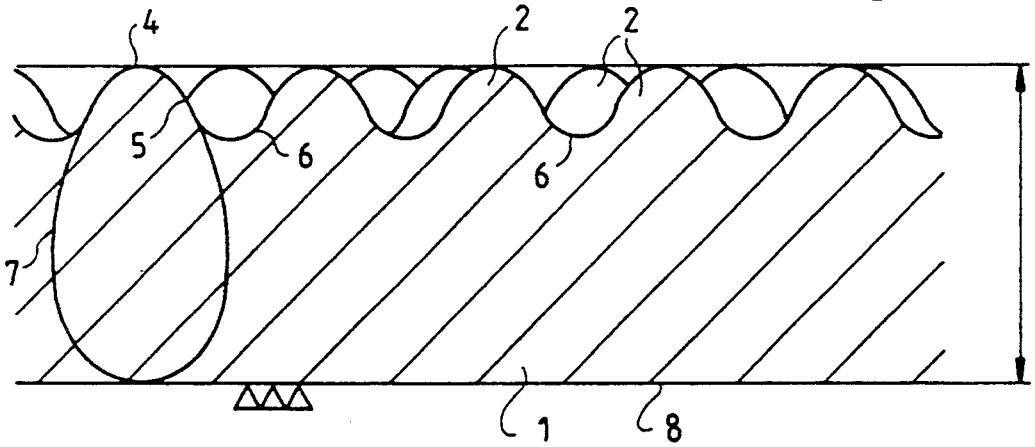
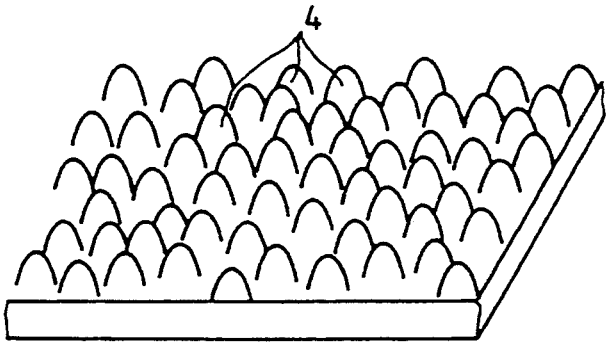
Fig.3

FOIL FOR COVERING AN IMPRESSION CYLINDER

FIELD OF THE INVENTION

The invention relates to a foil for covering an impression cylinder of a rotary offset printing press for first form and perfector printing, more particularly, the foil being formed of a chemically and wear-resistant rigid support layer having good ink transfer behavior and having a calotte-structured surface with statistically uniformly distributed convex and concave structural elements thereon, and a microroughness-reducing chromium layer disposed on the rigid support layer and forming a sheet-guiding outer cylindrical surface of the impression cylinder, the convex structural elements having respective peaks for supporting a sheet thereon.

Description of the Prior Art

Such a foil has become known heretofore from the European Patent Document EP 0 017 776 B1. According to this disclosure, nickel, chromium-nickel-steel, or a plastic material of high elasticity is provided as a backing layer, and a chromium coating is applied to this backing layer for smoothing or evening out the microroughness. The backing layer has a surface heretofore known from the published German Patent Document 24 46 188 C3, which is formed of statistically uniform yet irregularly distributed convex and concave structural elements, of which the convex structural elements are formed as spherical calottes, so that a sheet is supported by respective peaks of these spherical calottes. With such a foil, often called an anti-smear foil, applied to an impression cylinder, the ink transfer behavior of the outer cylindrical surface of the sheet-guiding impression cylinder is markedly improved when compared with the heretofore known developments. The foil not only prevents the occurrence of smearing or smudging of the just-printed first-form side, i.e., the recto-printed side, after the respective sheet has been turned, but it also improves the print quality of the side which is perfector-printed, i.e., the verso-printed side. This improvement in the foil of the aforementioned German patent document has been attributed mainly to the construction of the sheet-supporting surfaces of the backing layer as an array of spherical calottes, because the spherical shape facilitates the transfer of accepted ink. The chrome-plating of the foil results in good ink transfer behavior even as early as in the start-up phase and can be washed more readily than the formerly somewhat rougher backing layer. The very hard chromium layer prolongs the durability of the sheet-guiding foil, so that good ink transfer behavior of the foil is practically maintained over its entire service life.

Other proposals for improving the ink transfer behavior of an impression cylinder of a sheet-fed rotary offset printing press for first-form and perfector or recto/-verso printing could not achieve the results obtained with the foil according to the hereinaforementioned European Patent Document 0 017 776 B1. From the published German Patent Document 28 20 549 A1, it has become known heretofore to apply a thin nickel layer with a hard-nickel coating to a sandblasted surface of a backing layer formed of aluminum or copper. According to the published German Patent Document 12 58 873 B1, a chromium layer is applied in place of the nickel layer. However, this does not provide any improvement in the effect on the ink transfer behavior over the effect achieved with the foil according to the aforementioned published European Patent Document 0 017 776 B1.

From a company publication or pamphlet issued by the Minnesota Mining & Manufacturing Co. GmbH, Duesseldorf, Germany, a cover sheet for an impression cylinder of a web-fed rotary printing press has become known which is formed of a strong hemp-paper packing having a coating of synthetic resin containing a powder of microscopically small glass pellets. With this arrangement, another attempt is made in the recto and verso printing of webs to achieve results likewise with a surface structure of spherical calottes which come close to the results achieved with a foil according to the aforementioned published European Patent Document 0 017 776 B1.

From the French Patent A 2 283 995, a sheet-guiding foil has become known heretofore which is formed of nickel and serves as a covering for an impression cylinder of rotary printing presses for recto/verso or first-form and perfector printing, one of the surfaces of the covering being smooth and the opposite surface thereof being provided with statistically uniformly distributed spherical calottes of mutually equal height. This metal foil is produced in accordance with the conventional method of galvanoplastic molding by means of a negative mold formed of nickel. The first of the foils formed in such a negative mold are relatively smooth. However, the greater the number of foils which are formed, the greater is the microroughness appearing on the structured surface. On the other hand, it was observed that such foils exhibited a reduced ink transfer behavior after being used in the start-up phase. Only after a relatively lengthy use of the foil in the press, was the optimal ink transfer behavior reached.

SUMMARY OF THE INVENTION

It is accordingly an object of the invention to provide a foil of the foregoing general type having improved printing-technology characteristics with respect to an increase in quality of the printing results in recto/verso or first-form and perfector printing, particularly in multi-color printing and in printing with a low screen count, while maintaining all of the heretoforeknown advantages.

With the foregoing and other objects in view, there is provided, in accordance with the invention, a foil for covering an impression cylinder of a rotary offset printing press for first-form and perfector printing, the foil being formed of a chemically and wear-resistant rigid support layer having good ink transfer behavior and having a structured surface with statistically uniformly distributed convex and concave structural elements thereon, and a microroughness-reducing chromium layer disposed on the rigid support layer and forming a sheet-guiding outer cylindrical surface of the impression cylinder, comprising respective peaks formed on the convex structural elements for supporting a sheet thereon, each of the convex structural elements having an oval shape with a radius of curvature increasing from the respective peak thereof to a transition into respective concave structural elements adjacent thereto.

The ink transfer behavior is considerably benefitted thereby, which results in a clearly visible improvement in the quality of the print, especially for dull-finish or matt papers, thin papers, and low screen counts within the range of 80 to 100 lines per cm. The novel structure of the foil according to the invention permits a tighter spacing between sheet-supporting points for a like pressure area, so that the specific pressure per peak of the convex structural element is reduced. By grinding the foil on the underside thereof, very precise thicknesses with minimal tolerance ranges can be achieved, so that the foil is especially suitable also for double-size impression cylinders in recto/verso or first-form and perfector printing presses without a drying facility.

A clearly perceptible increase in quality of the printed image in recto/verso or first-form and perfector printing presses and in eight-color printing presses in a 4/4 operation, which are currently in great demand, can be achieved, after the sheet has been turned, in connection with a joint fine-adjustment of the pressure in the printing nip by means of an electronic computer control system, depending upon the paper quality and the printing form.

Essential to the advantages derived from the invention of the instant application is the shape of the tips of the egg-like convex structural elements, which are all of substantially the same height, thereby effecting a precise and differentiated ink transfer behavior. Advantageously, it is possible to arrange the support points in a greater density than heretofore, so that they are situated closer to one another than is possible with the spherical calottes of the prior art and, for the same pressure area, less contact pressure need be applied.

In accordance with another feature of the invention, the oval-shaped convex structural elements, in respective optical enlargements thereof, have the shape of a tip of an egg.

In accordance with a further feature of the invention, the convex and the concave structural elements merge directly into one another.

In accordance with a concomitant feature of the invention, depending upon the printing job to be performed by the printing press, the foil has a predetermined ratio of the peak of the convex structural elements to a base of the concave structural elements, on one hand, and between the heights of the convex and concave structural elements, on the other hand.

The heretofore known and utilized advantages of foils formed of a backing or carrier layer, for example, of nickel and a chromium coating, particularly the replaceability of the foil, are maintained, so that an advance adjustment to the quality of the printing paper and to the print form can be effected by the selection of a foil, for example, with a different thickness or a different knub or burl structure. Also, the option of replacing a conventional foil is maintained, for example, replacement of a foil for performing printing orders based upon a different screen count, such as up to 120 lines per cm., for example.

A structurally suitable foil for a printing order can be applied quickly, if necessary or desirable, and most effectively by means of an automatic foil replacement device.

A mold for galvanically molding the surface structure and the foil, respectively, in accordance with the invention can be made by applying galvanic techniques, by etching, or by laser-type engraving. The method of producing the foil is not affected or influenced by the features of this invention.

Other features which are considered as characteristic for the invention are set forth in the appended claims.

Although the invention is illustrated and described herein as embodied in a foil for covering an impression cylinder of a rotary offset printing press for first-form and perfector printing, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which:

FIG. 1 is a cross-sectional view on an enlarged scale of an ink-feeding foil according to the invention;

FIG. 2 is a view similar to that of FIG. 1 showing the foil without any ink feed;

FIG. 3 is a fragmentary, reduced top, front and side perspective view of the foil of FIG. 2 showing the structured surface thereof.

DESCRIPTION OF THE PREFERRED EMBODIMENTS

Figure 4:
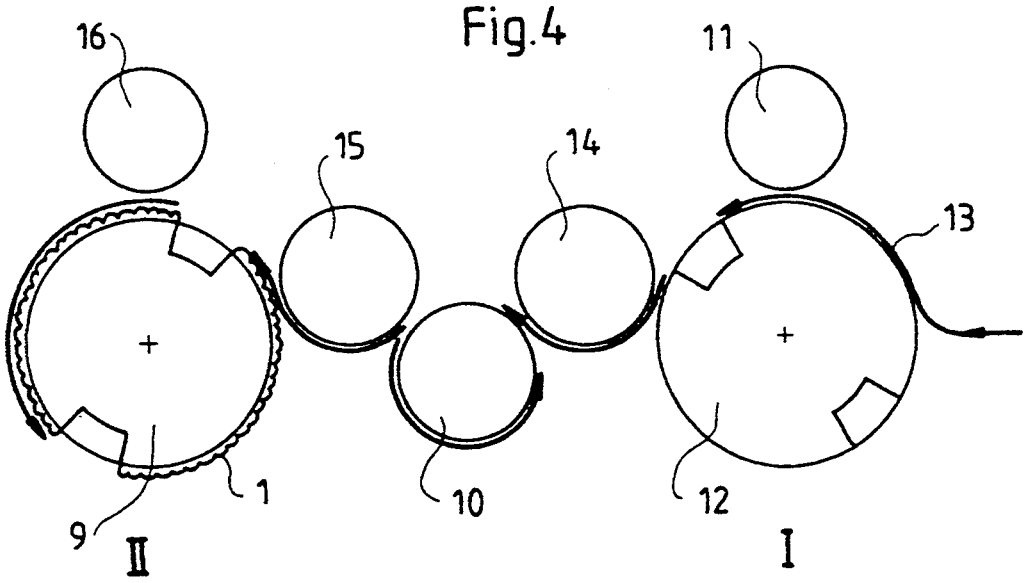
FIG. 4 is a diagrammatic view, greatly reduced in scale over that of the preceding figures, of an arrangement of the foil on an impression cylinder of a printing press for performing recto/verso or first-form and perfector printing.

Referring now to the drawings and, first, particularly to FIG. 1 thereof, there is shown therein a foil 1 for guiding or carrying a sheet on the circumference of an impression cylinder of a printing press, the foil 1 being formed of either nickel, chrome-nickel-steel, or plastic material. The foil has a thickness of approximately 0.2 to 0.4 mm. The surface of the foil 1 is made up of an array of statistically uniformly distributed convex and concave structural elements, the convex structural elements 2 being formed as knolls or domes having respective peaks disposed substantially at the same height or level. Sheets on the impression cylinder are supported by these peaks of the domes 2. The height of the respective domes 2 with respect to the concave structures is approximately 0.03 to 0.04 mm. At the left-hand side of FIG. 1, ink separation is symbolically illustrated by the lifting of a sheet from a respective dome 2. The circles 3 shown drawn in FIG. 1 illustrate the form of the spherical calottes of the heretoforeknown constructions thereof, in order to emphasize the differences in the construction according to the invention over that of the state of the art. The convex structural elements 2 according to the invention permit more space to be provided for receiving ink than the heretoforeknown spherical calottes. This advantageous space distribution in accordance with the invention also facilitates the removal of ink deposits, which means that the latter can be washed from the foil 1 more readily and more rapidly.

FIG. 2 shows the same foil 1, however, without any ink feed. The convex structural elements 2 have an oval shape, the radius of curvature of which increasing, from a peak 4 to a transition 5 into concave structural elements 6, e.g., becoming gradually greater. Thus, in a respective exemplary embodiment, as indicated in FIG. 2 in an optical extension of one of the oval-shaped structural elements 2 only for the purpose of illustration, it takes on the shape of an egg 7, especially the shape of a hen's egg, the size of which is defined by the very top of the peak 4 and the underside 8 of the foil 1. Consequently, the radius of curvature of the convex structural elements 2 which are defined by the tip of the egg 7 becomes gradually greater or increases from the peak 4 to the transition 5 into the concave structural elements 6.

In this arrangement, also, the tops of the peaks 4 of the convex structural elements 2 are at substantially the same height. The structural elements 2 are conventionally distributed statistically as uniformly as possible, even though they are irregularly arranged. In a preferred embodiment, the convex structural elements 2 merge directly into the concave structural elements 6, so that the convex structural elements 2 are closer to one another than in the heretoforeknown arrangement represented by the circles 3 according to FIG. 1. The relatively narrow or tightly-spaced arrangement of the convex structural elements 2 resulting therefrom is illustrated in FIG. 3. In departing from the heretofore known conventional concept that a spherical form of the structural elements facilitates the ink separation while the sheet is lifted off from the impression cylinder, it has been discovered that the oval form according to the invention, wherein the radius of curvature towards the respective tips of the peaks 4 of the convex structural elements 2 gradually becomes smaller, results in an essential improvement in ink separation and thereby in a perceptible improvement in print quality. Due to the smaller support surface provided by the domes 2, as opposed to the spherical calottes, the ink feed is reduced, so that the following sheet has less ink to take away. Further transport of the ink thereby becomes more reliable.

In FIG. 4, the arrangement of the foil 1 is shown on an impression cylinder 9 having double the diameter of the conventional blanket cylinder 16 and non-illustrated plate cylinder of a rotary offset printing press in the perfector or verso printing mode, after a sheet turning by a storage cylinder 10 and and a turning cylinder 15, as described hereinbefore. The sheet 13, having been recto-printed or first-form printed in the nip between the blanket cylinder 11 and another double-size impression cylinder 12, is fed to the storage cylinder 10 by a transport cylinder 14 and then turned by the turning cylinder 15 to enter the nip between the blanket cylinder 16 and the impression cylinder 9 for perfector printing.

I claim:

1. Foil for covering an impression cylinder of a rotary offset printing press for first-form and perfector printing, the foil being formed of a chemically and wear-resistant rigid support layer having good ink transfer behavior and having a structured surface with statistically uniformly distributed convex and concave structural elements thereon, and a microroughness-reducing chromium layer disposed on the rigid support layer and forming a sheet-guiding outer cylindrical surface of the impression cylinder, comprising respective peaks formed on the convex structural elements for supporting a sheet thereon, each of the convex structural elements having an oval shape with a radius of curvature increasing from the respective peak thereof to a transition into respective concave structural elements adjacent thereto.

2. Foil according to claim 1, wherein the oval-shaped convex structural elements, in respective optical extensions thereof, have the shape of a tip of an egg.

3. Foil according to claim 1, wherein the convex and the concave structural elements merge directly into one another.

* * * * *